United States Patent [19]

Colamussi

[11] Patent Number: 4,498,273

[45] Date of Patent: Feb. 12, 1985

[54] SYSTEM FOR PACKAGING ICE-CREAM CONES AND LIKE ARTICLES

[76] Inventor: Arturo Colamussi, Via Borso 8, Ferrara, Italy

[21] Appl. No.: 330,860

[22] Filed: Dec. 15, 1981

[30] Foreign Application Priority Data

Dec. 15, 1980 [IT] Italy ..... 9012 A/80

[51] Int. Cl.[3] ..... B65B 25/00; B65B 57/10

[52] U.S. Cl. ..... 53/54; 198/389; 53/142; 53/143; 53/498

[58] Field of Search ..... 53/54, 52, 493, 498, 53/500, 142, 143; 198/389, 360; 221/159, 164, 165

[56] References Cited

U.S. PATENT DOCUMENTS

| | | | |
|---|---|---|---|
| 2,846,830 | 8/1958 | Bossi | 53/143 X |
| 2,971,305 | 2/1961 | Webster et al. | 53/493 |
| 3,277,997 | 10/1966 | Hannah et al. | 198/389 |
| 3,486,511 | 12/1969 | Salvesen | 221/159 X |
| 3,517,797 | 6/1970 | Daleffe et al. | 198/389 |
| 3,802,154 | 4/1974 | Dillon | 53/143 X |
| 3,823,815 | 7/1974 | Bretten et al. | 198/389 |
| 3,938,654 | 2/1976 | Mohr | 221/159 X |
| 4,094,129 | 6/1978 | List | 53/493 X |

*Primary Examiner*—James F. Coan

*Attorney, Agent, or Firm*—Oblon, Fisher, Spivak, McClelland & Maier

[57] ABSTRACT

A system for packaging into cartons cones for ice-cream and other cornet-like articles coming loosely from a production unit wherein in a first processing station (A) splitting of the cone feed main stream into a plurality of individual sub-streams occurs. In a second processing station (B) a temporary cone-storage field is made up, the cones being orderly marshalled in a number of rows, the cone axes being vertical with the cone tips upside down and the cones being closely spaced apart from each other. From said second processing station (B) the cone rows are transferred into a third processing station (C), wherein, for each cone row, a belt having evenly spaced apart bores is provided for receiving individual cones. Each belt is independently motorized for stepwise forward motion. As a predetermined number of bores in each belt carries as many cones as there are bores, a cone-grasping unit (E) draws the cone row and transfers it into empty cartons. If so desired, the cones can be deposited in the cartons alternatingly by the cone-grasping unit (E) with their tips upside down, and with their tips directed upward by the utilization of a tipping device.

27 Claims, 20 Drawing Figures

SYSTEM FOR PACKAGING ICE-CREAM CONES AND LIKE ARTICLES

BACKGROUND OF THE INVENTION

1. Field of the Invention

This invention relates to a system for packaging into cartons ice-cream cones and like articles in the cornet form.

2. Description of the Prior Art

Ice-cream cones exiting a production unit, more particularly the cone-filling machine and the refrigeration tunnel, are usually packaged in cartons to be shipped to the retailers. Each carton contains a certain number of cones arranged in an orderly, echelon formation, so as to enable inspection of the carton contents at a glance. On account of the geometrical form of such cones and with a view to exploiting the carton capacity in an appropriate way, the cones are generally positioned in the cartons in adjoining rows arranged in alternating directions, that is to say that, in a row, the cones are placed with their tips pointing upwards, whereas they are set with their tips pointing downwards in the adjoining row, and so on. A particular arrangement is that having two cone rows with the tips pointing upwards and two subsequent rows with the cone tips pointing downwards.

Heretofore, the packaging of such cones in cartons was customarily carried out manually, the result being a great demand both in terms of time and labor. Automatization of such operation was thus a long-felt want.

SUMMARY OF THE INVENTION

Therefore, it is an object of the present invention to provide a system which is capable of carrying out the packaging in cartons of ice-cream cones or similar cornet-like articles into cartons automatically by totally dispensing with manual labor so as to perform the operation in question with considerable time savings too.

When facing the problem of the automatic packaging in cartons of articles of the kind referred to above, many difficulties have been encountered which are due, on the one hand, to the particular geometric form of the articles and, on the other hand, to the fact that the cones as dispensed by the production unit arrive, for example, at a conveyor belt in loose fashion, that is without any orderly orientation. Another difficulty is due to the fact that the rate at which the articles are fed may undergo variations of an instantaneous nature, which must be smoothed in the packaging station. In order that a regular, continuous and undisturbed operation of the packaging system may be assured, and also in order to eliminate or at least minimize the intervention of attendants, a number of expedients is then necessary, which are adapted to forestall phenomena of article gathering-up and irregular positioning, susceptible of jeopardizing correct operation of the system.

The system provided by the present invention for packaging ice-cream cones into cartons is so conceived as to solve all of these problems concurrently and to ensure correct automatic operation.

The system is characterized in its substance, by comprising:

(a) a first station composed of a chute having individual races for splitting the main feed stream of cones which arrive, loosely, into a preselected number of substreams, and for previously orienting the cones with their axes parallel to the direction of each individual substream;

(b) a second station composed of pairs of conveyor belts the number of which corresponds to the number of the individual sub-streams as formed by the first station, so as to originate a temporary cone-storage field having a forward motion, each of said conveyor belt couples having associated therewith devices for marshalling the cones mutually spaced apart between the respective pairs of belts, the cone axes being vertical and the cone tips upside down;

(c) a third station composed of a number of belts which are parallel and horizontal and correspond to the number of pairs of conveyor belts of the second station, each of said parallel horizontal belts having a row of seats adapted to receive individual cones with their axes vertical and their tips pointing downward, each of said latter belts being independently motorized relative to the other belts, means being provided for detecting the positioning of every individual cone in any of the seats in the belts so to consequentially command the forward stepping of the relevant belt by a step corresponding to the gap between two consecutive seats;

(d) means for transferring the cones from said second to said third station, said means consisting of members which can be controlled so as to take either of two positions, one of these being a position wherein the cones are fed to the seats in the belts of the third station, the other position being one in which cones coming from the second section are discarded, said rejection position for certain cones being associated by a cone-recycling unit to feed back the rejected cones to a spot upstream of said first station, detecting means being associated to each of the belts of the third station to detect the presence of cones in a predetermined number of consecutive seats on the respective belt and to control the switching of the relevant transfer member from the first to the second position if cones are present in said number of seats, and to allow this member to be switched back to its first position if said seats are empty;

(e) an apparatus, in said third station, for grasping the cones hich have been positioned in said determined number of seats of at least one belt, said apparatus being liftable perpendicularly to the direction of advance of the parallel belts of the third station to selectively grasp the cones from the several belts, to transfer the grasped cones to at least one position adjacent to said belts and to introduce the cones into empty cartons.

Preferably, the grasped cones are alternate transferred into either of two positions which are adjacent to said belts. If so, a device is provided, in one of said positions adjacent to the belts of the third station, a tipping mechanism of which is adapted to receive the cones grasped by said cone-grasping device in a position wherein the cones have their tips upside down and to overturn the thus received cones through 180 degrees so as to arrange them with their tips up, there being provided, in the second of said positions adjacent to the belts, a carton conveyor which is adapted to feed a succession of empty carton close to said third station, and to carry away the cartons which have been filled with cones, said cone-grasping unit being adapted alternately to place the cone array which have been grasped onto said tipping mechanism and directly into the cartons, the cones positioned onto said tipping device being deposited, by the same device, into the cartons as the 180° tipping motion of said mechanism is completed.

The system for carton filling, as generally outlined hereinabove, is equipped, of course, with appropriate ancillary checking and controlling devices having a synchronizing function, so as to ensure a completely automatized operation.

BRIEF DESCRIPTION OF THE DRAWINGS

Closer structural and operational details will become apparent in a clearer fashion from the ensuing description of an exemplary embodiment of the invention, as illustrated in the accompanying drawings, wherein.

DETAILED DESCRIPTION OF THE PREFERRED EMBODIMENTS

Figure 1:
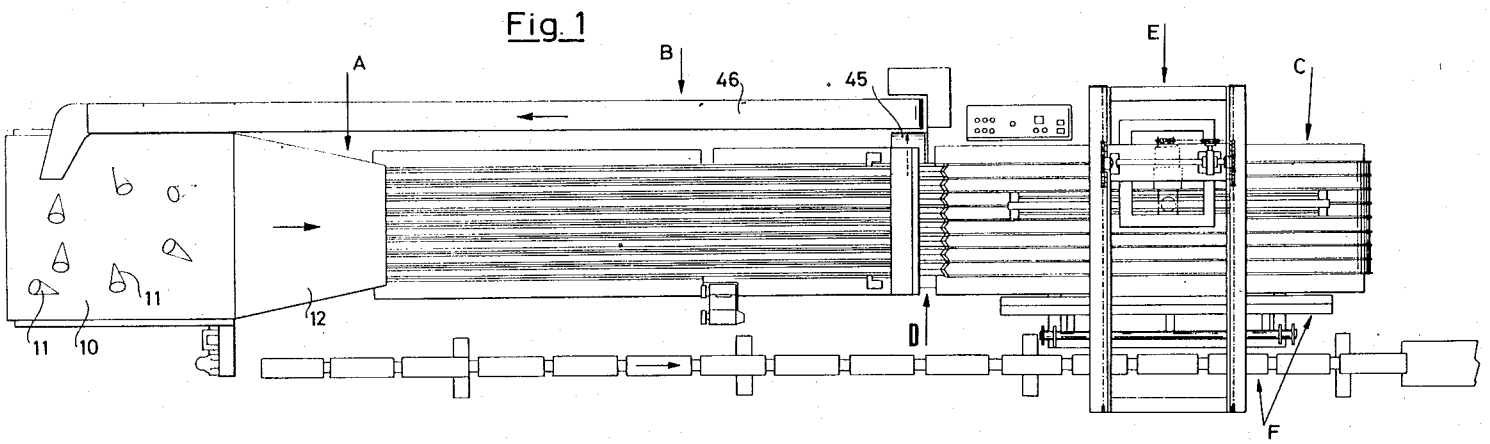
FIG. 1 is a diagrammatical top plan overall view of the system.
Figure 2:
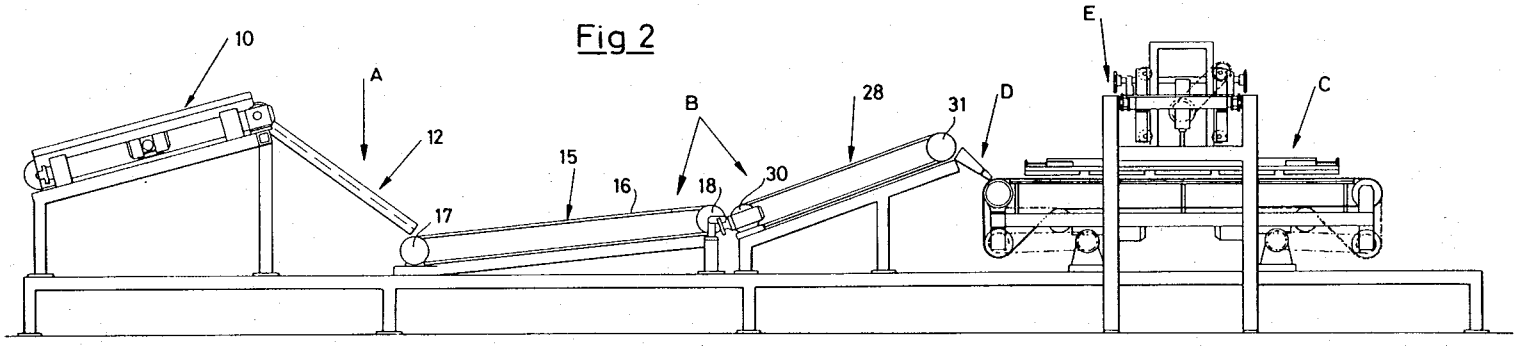
FIG. 2 is a diagrammatical side elevational view of the same system.

FIGS. 1 and 2 are overall views of the packaging system according to the invention. From these FIGURES, it can clearly be appreciated that the system is comprised of a first station, A, a second station, B, and a third station, C, means, D, for transferring the ice-cream cones from the second to the third processing station, a cone-grasping unit, E, in the third station, and, besides the third station C, two positions F, for discharging the cones which have been grasped by the unit E.

Figure 3:
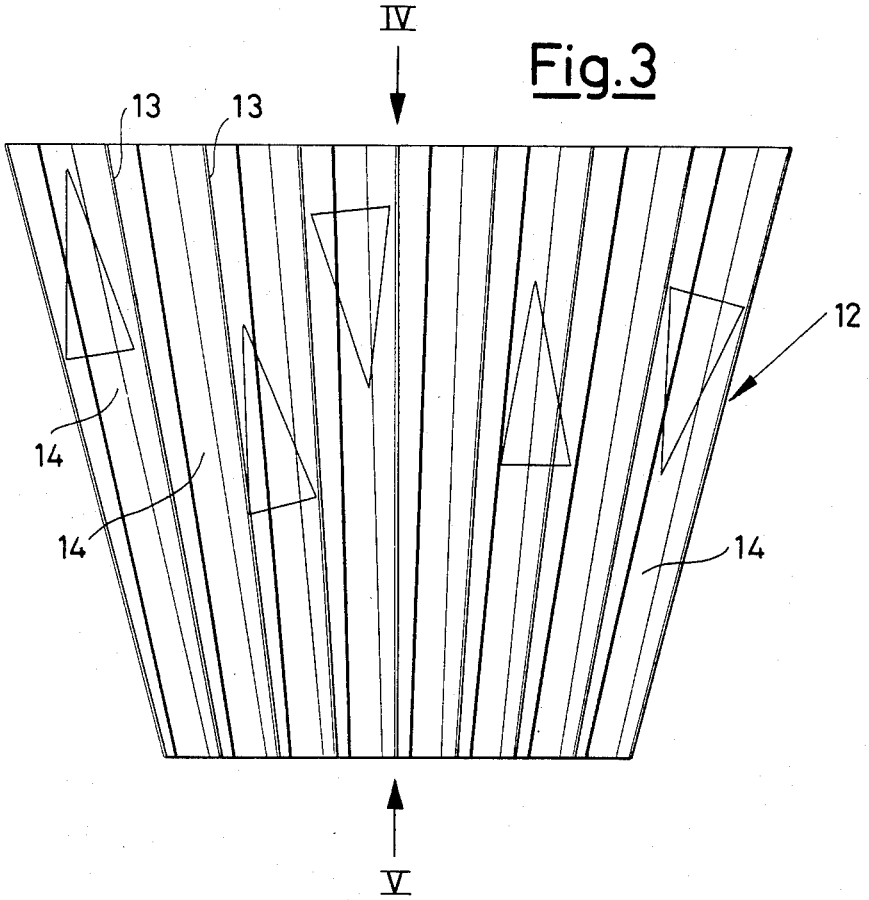
FIG. 3 is a first processing station of the system, shown in plan.

Upstream of the first processing station, A, a belt matting 10 is provided, which receives, from a production unit (not shown), for example from a refrigeration tunnel of such unit, by means of a conveying unit (not shown) a main stream of cones, 11, loosely fed forward, that is to say, without any predetermined regular orientation of the cones. This conveying belt matting 10 is arranged in a sloping, ascending direction and exploits its slope for undoing possible cone heaps which might have been built up as a result of irregular conveyance. In addition, the belt 10 has the task of originating a nearly homogeneous layer of cones, so as to encourage the forthcoming correct splitting (or subdivision) of the main feeding stream into a certain number of individual sub-streams of cones in the first processing station, A, of the system. Such splitting operation is brought about by a chute 12 (best seen in FIGS. 3–5) which is preferably made of stainless steel and, by the intermediary of partition walls such as walls 13, is partitioned into a certain number of races, such as indicated by reference number 14 (in the example shown the races are eight in number), quite consistently with the potential system throughput.

Figure 4:
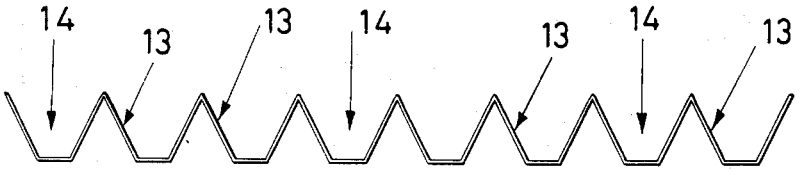
FIGS. 4 and 5 are views, taken along the lines IV—IV and V—V, respectively, of FIG. 3, of the first processing station shown therein.
Figure 5:
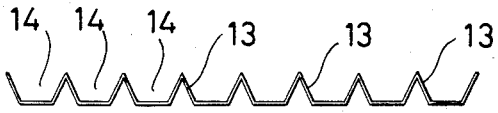

It should be noted that each of these races narrows in the direction proceeding from the inlet opening (which is wider, as best seen in FIG. 4) towards the exit opening (narrower, as best seen in FIG. 5), to enable the cones 11 to find a quick positioning in the race which is placed before the position at which the cones are dumped from the belt 10. In addition, in the races 14 of the chute 12, the cones receive a first orientation with their axes parallel to the direction of the individual races.

From the station A, that is from the exit openings of the races 14 of the chute 12, the cones 11 reach the processing station B of the system.

Figure 6:
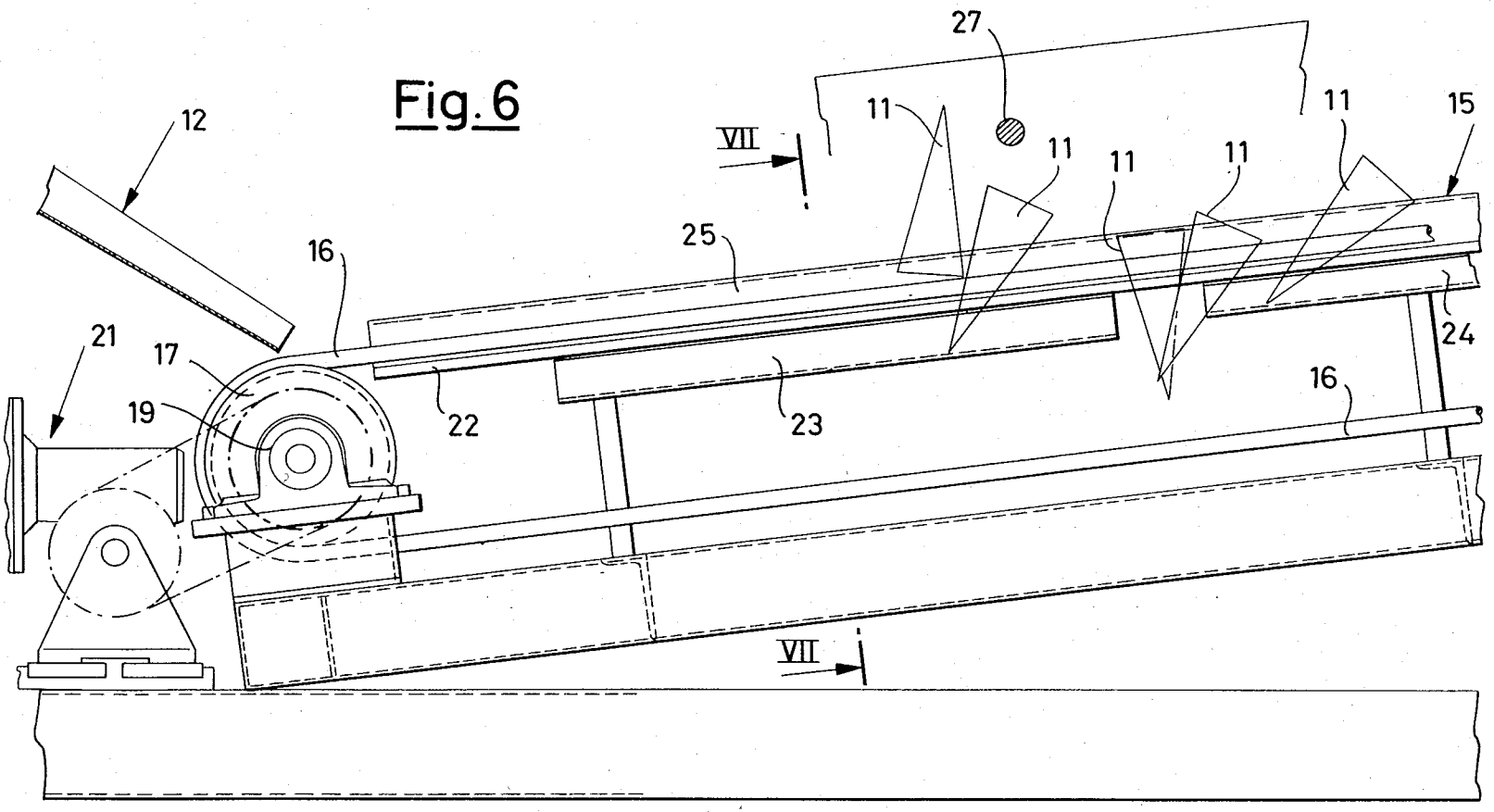
FIG. 6 is a fragmentary side elevational view of a first portion of a second processing station of the system.
Figure 7:
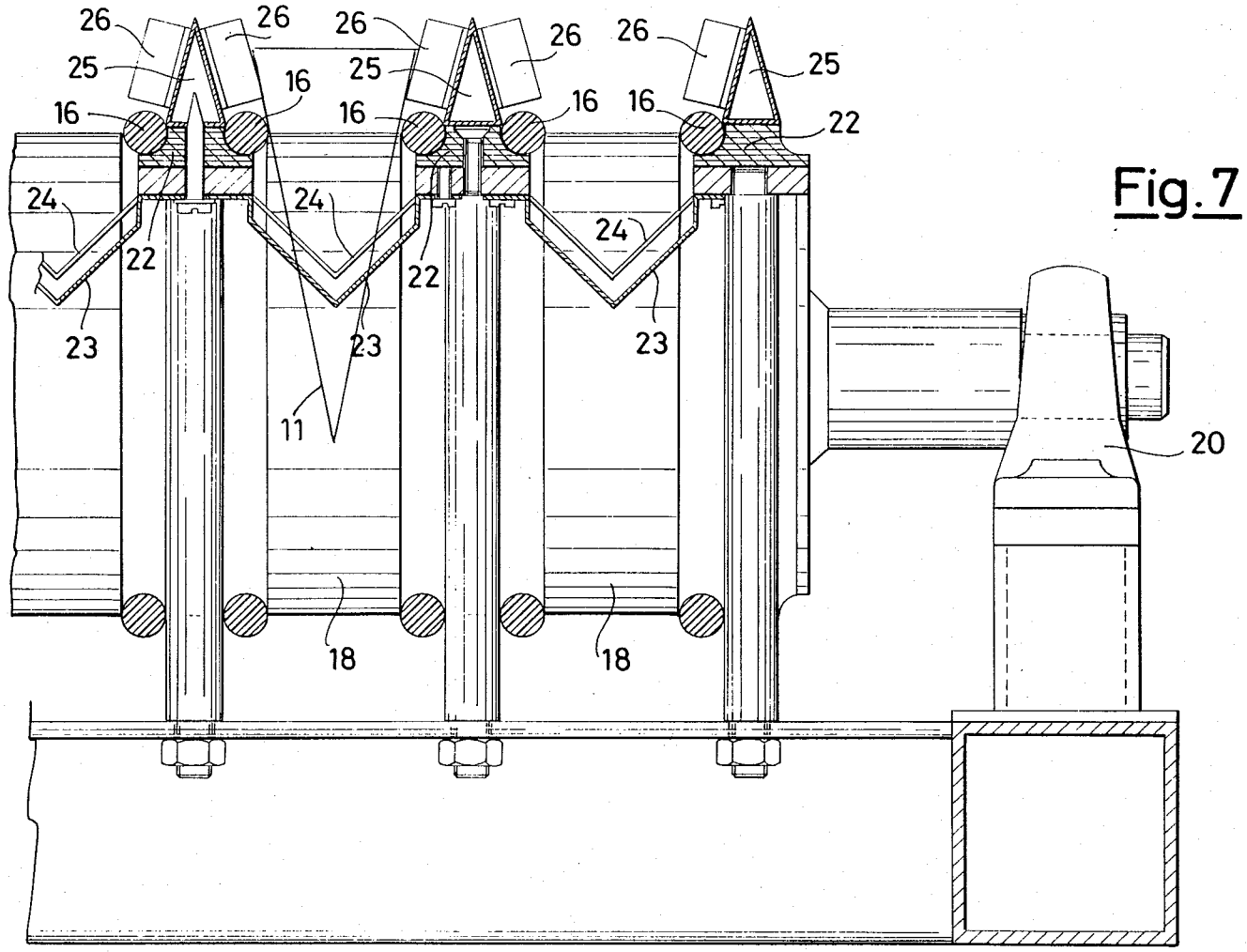
FIG. 7 is a partial cross-sectional view taken along the line VII—VII of FIG. 6.
Figure 8:
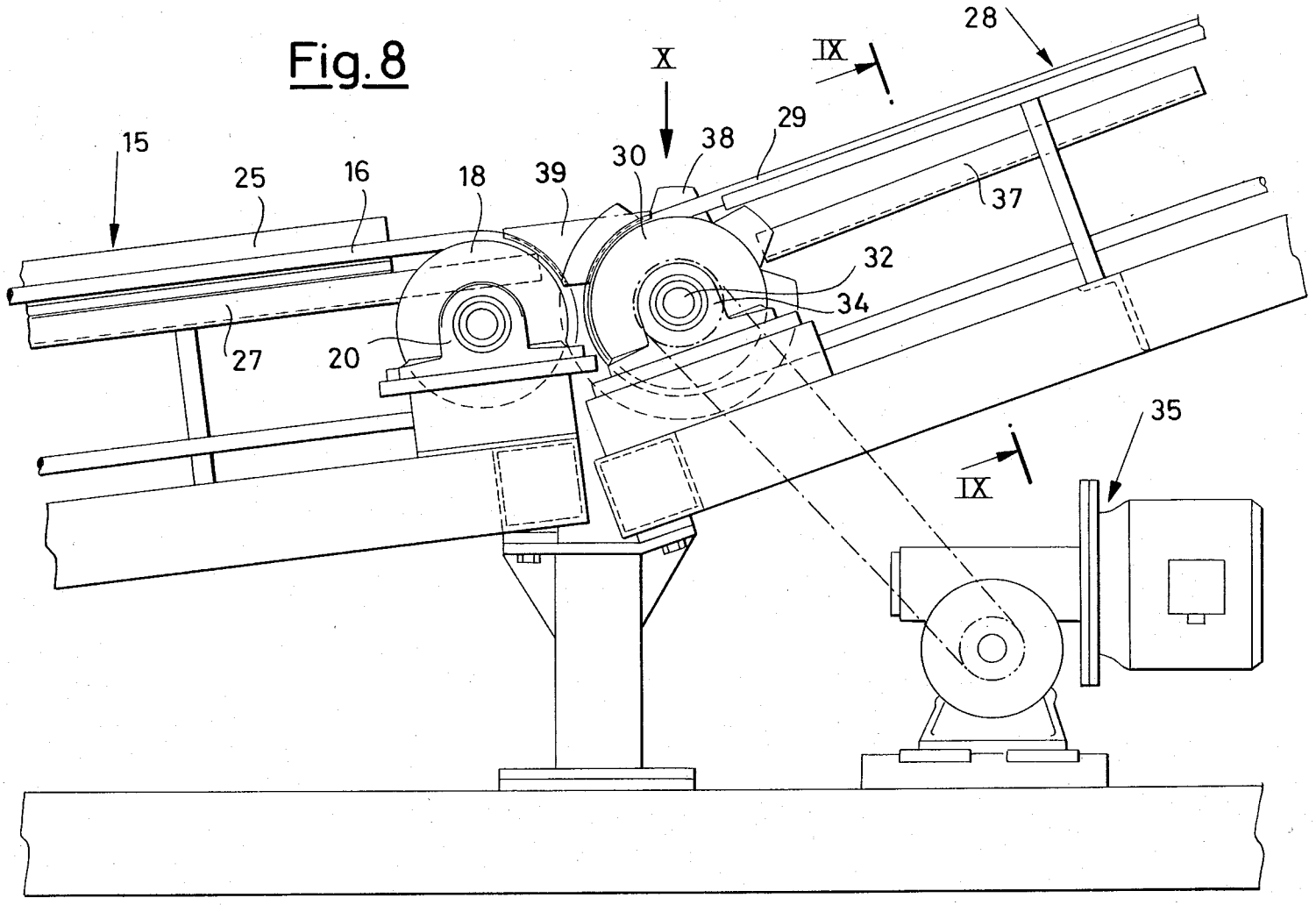
FIG. 8 is a side elevational view of the central portion of the second processing station of the installation.
Figure 9:
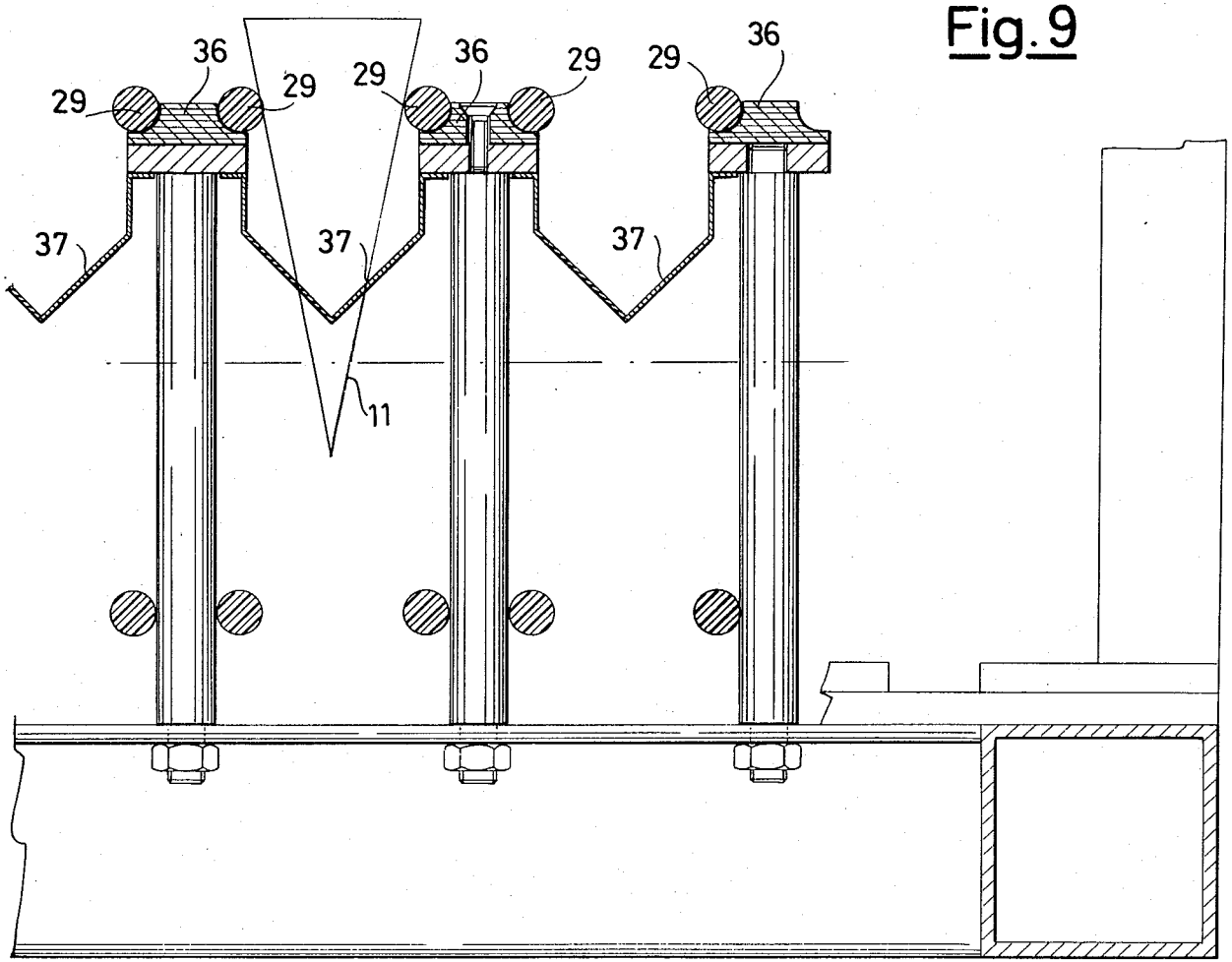
FIG. 9 is a fragmentary cross-sectional view taken along the line IX—IX of FIG. 8.
Figure 10:
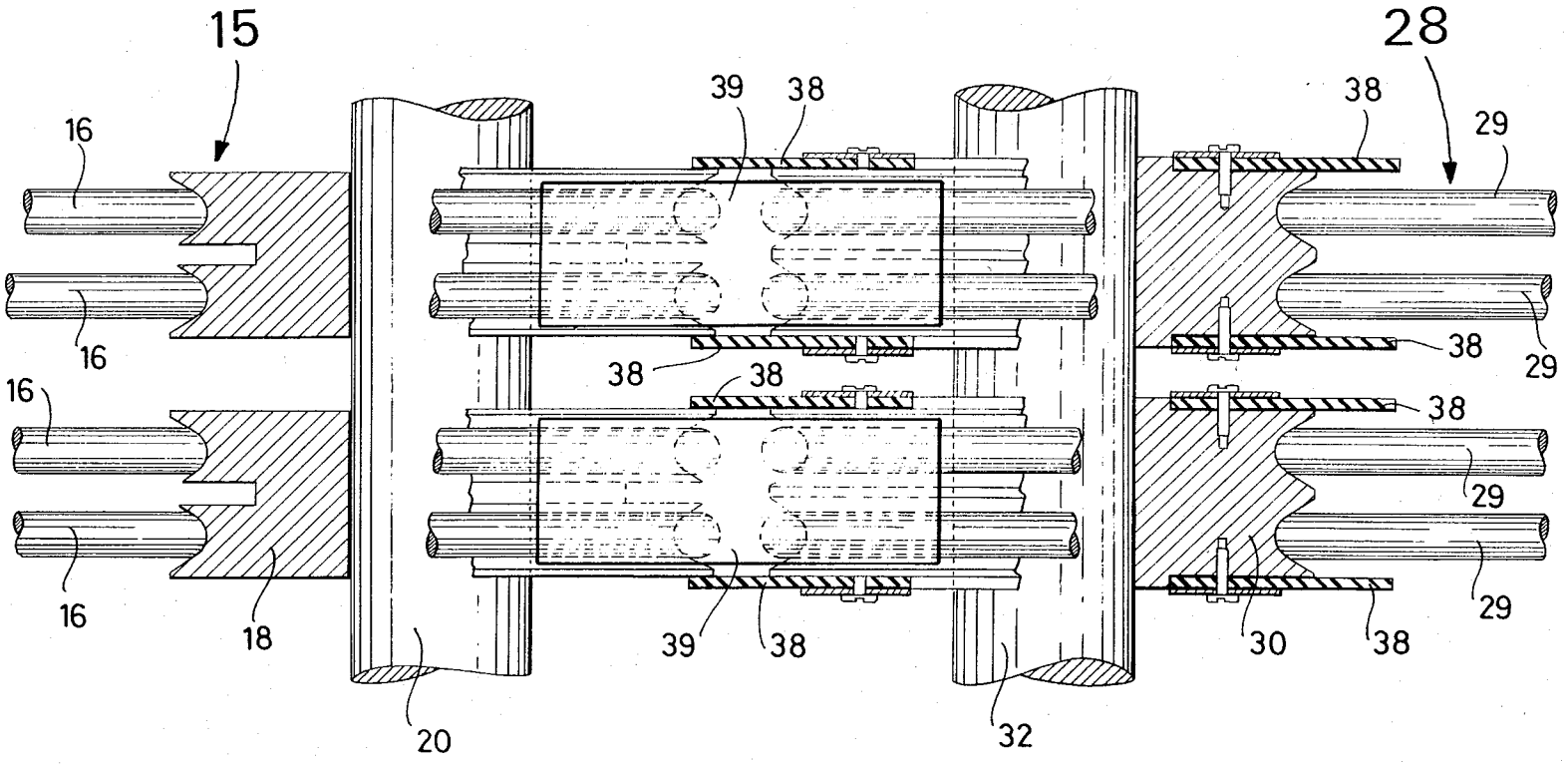
FIG. 10 is a plan view of the portion of the system which has been shown in FIG. 8.

In the station B a first conveying unit 15 is provided, which is slightly sloping upwards and composed of a plurality of paired belts 16 which are circular in cross-section, as best seen in FIGS. 6 to 8. The number of said paired belts 16 corresponds to the number of races 14 of the chute 12 and each couple of belts 16 is nothing else other than a corresponding feeding race for the cones. All the belts 16 are guided over a driving roller 17 (FIG. 6) and over idling sheaves 18 (FIGS. 8 and 10), having appropriate peripheral grooves for receiving the belts 16 staggered at the proper mutual distances from each other. The shafts of the roller 17 and the sheaves 18 are journalled for rotation in journals 19 and 20, respectively. The roller 17 is driven by a motorized reducing gear 21.

Between the roller 17 and the sheaves 18, the upper active laps of the belts 16 are guided within appropriate grooves of guiding members 22 (as best seen in FIG. 7) which maintain and support said upper laps of the belts at the correct mutual distances. It should be observed that the distance between the axes of each belt of a belt pair 16 is such as to allow the cones 11 to take only one position, that is with the base up and the tip down, suspended between two belts of each belt pair. In actual practice, the diameter of the base of each cone must exceed the distance between the axes of the two belts of each belt couple, less the diameter of an individual belt.

The task of said first conveying unit 15, consisting of pairs of belts 16, as well as the purpose of a second line conveyor to be described hereinafter, is to provide an orderly temporary storage of cones 11 which is capable of smoothing instantaneous variations in the cone-feeding stream. In order to reduce to practice such an orderly temporary storage of aligned cones hung between adjoining belts, without originating cone gathering phenomena or causing any abandonment of the belts by the cones, it has been ascertained that it is advisable to have the cones suspended between the belts to assume, at the outset, a laid down position which is arreared relative to cone base placed upward. This result can be achieved by inserting, beneath each pair of belts, V-shaped channels arranged at such a distance apart from the belts as to compel the tips of the cones driven by said belts to creep along the walls of said V-shaped channels.

It should be observed that a few precautions should be taken in order that such a result may successfully be achieved.

The belts 16 for conveying the cones 11 must have an adequate advancing speed in order that the cones 11 which are dropped from the chute 12 may properly be marshalled so as to ensure that they are spaced apart from each other, because, if not so, the cones might mutually disturb one another. In addition, the belts 16 must be advantageously of such a material as to offer a low friction coefficient relatively to the cones, so as to check the force with which the cones are entrained.

The arrangement of the V-shaped channels suggested above is as follows.

Along a first shank of the conveying unit 15, beneath each belt couple 16, a first V-shaped channel is arranged, indicated at 23 in FIGS. 6 and 7, which is secured to guiding members such as 22. Longitudinally spaced apart from said first V-shaped channel 23, a second V-shaped channel, 24, is provided, still beneath each pair of belts 16, which is equally secured to the guiding members 22: this second V-shaped channel 24 should be placed at a higher level than the first V-shaped channel, still beneath the attendant couple of belts, that is, closer to said belts 16.

Such an arrangement of the two V-shaped channels, one past the other, with a certain free space therebetween and with the second channel placed at a higher level than the first, is intended to correct possible irregular positions of the cones if the latter should tend to assume a laid down position, but with the cone tip pointing forwards, that which would prejudice the possibility of obtaining a well ordered temporary cone storage. As a matter of fact, the cones which are fed forward by the paired belts 16, become positioned in a laid down manner as their tips meet the first channel 23, but the possibility exists that their tips, instead of pointing backwards might point forwards. When the cone tips are no longer sustained by the first channel 23, in the gap between the first and the second channel, the suspended cones take a vertical posture and, immediately thereafter, meet the second channel 24 which is positioned at a higher level, so that their tips are certainly placed so as to point backwards.

The possibility of jams occurring between the cones conveyed by a couple of belts 16 and the cones suspended between an adjoining couple of belts 16 is offset by the presence of tubular profiles 25 having a triangular cross-sectional outline (best seen in FIG. 7), which are fastened to the guiding members 22 for the belts 16.

With a view to preventing cones which are possibly superposed or resting on the couples of belts 16 from being fed ahead in such a configuration, tangle-preventing webs 26 are secured to said tubular profiles 25. Irregularly conveyed cones would thus bump into the webs 26 and said webs would force the cones to become positioned in suspended position between the belt couples 16.

Lastly, cones which might possibly succeed in being fed forward with their tips pointing upwards rather than downwards, are brought back to the correct position by a resilient bar 27 which is a sort of a transversal obstacle above the conveyor unit 15 (as shown in FIG. 6).

As outlined above, in the processing station B of the system, the first conveying unit 15 is followed by a second conveying unit 28, which is composed, like the first one, of pairs of belts, 29, having a circular cross-sectional outline, the number of which is the same as that of the couples of belts 16 of the first conveying unit 15. Also the second conveying unit 28 is arranged sloping upwards, and it is preferred that its slope is steeper than that of the first conveying unit (FIG. 8).

The belts 29 are guided on driving sheaves 30 (FIGS. 8 and 10) and idlers 31 (FIG. 11), the former sheaves being keyed to a shaft 32 and the latter sheaves being mounted for rotation on journals 33. The shaft 32 is journalled for rotation in journals 34 and a motorized reducing gear 35 rotationally drives said shaft. It should be noted that the motorized reducing gear 35 controls the motion of the belts 29 at a speed which is considerably slower than that of the belts 16 of the first conveying unit 15.

The upper laps of the belts 29, between the driving sheaves 30 and the idlers 31, is guided and supported in grooves formed through guiding members 36.

In the initial portion of the conveying unit 28, beneath the couples of belts 29, V-shaped channels 37 are arranged, which are secured to the guiding members 36.

In order to encourage the transfer of the cones 11 from the first conveying unit 15 and the second conveying unit 28, the driving sheaves 30 of the second conveying unit 28 have, mounted laterally thereon, flanges 38 which are composed of a material having a high friction coefficient (such as soft rubber), which frictionally engage the surfaces of the cones and assist them in their transfer from the belts of the first conveying unit to those of the second conveying unit in a continuous run. In addition, in order to prevent defective alignment of the cones in the saddle-like space between the two conveying units, there are arranged in fixed positions properly shaped guiding aprons 39 between the races along which the cones are forwarded; these races are confined, in the first conveying unit 15, by the pairs of belts 16 and, in the second conveying unit 28, by the pairs of belts 29. These shaped aprons 39 partially shield the sheaves 18 of the conveying unit 15 and those, 30, of the conveying unit 28. The slower speed of advance of the belt couples 29 relative to the speed of the couples of belts 16 acts in such a way that, on the conveying unit 28, the cones 11 are positioned on the belts 29 in side by side relationship with respect to each other.

The V-shaped channels 37 in the initial shank of the second conveying unit 28 beneath the attendant couples of belts 29 cause the cones 11 to assume a laid down position with the cone tips pointing rearwards and with the head (i.e. the cone base) pointing forward. The axes of the cones are thus arranged at an angle and the head of a generic cone is in contact with the head surface of the preceding cone in the machine direction. In horizontal projection, there are thus elliptical sections of contact between the cones, with a mutual distance between the axes which is longer than that of the circular contact cross-sections which would be obtained if the cones should be arranged vertically. As the cone tips leave the V-shaped channels 37, the cones are restored to their vertical postures again, but are spaced apart at a mutual distance between adjacent axes which is equal to that of the ellipses of the previously considered contact sections. By so doing, a slight spreading of each cone 11 from its adjoining cones is obtained on the conveying unit 28.

As they reach the end of the second conveying unit 28, the cones 11 leave the second processing station B of the system under conditions of very satisfactory orientation with their axes vertical with the cone tips pointing downwards, the cones being slightly spaced apart from each other in the respective individual feeding rows or races.

Under these conditions, the cones must be transferred onto the third processing station C of the system, and transfer means D are specially provided for this purpose.

These transfer means are composed of individual rocking chutes 40 (best seen in FIGS. 11 and 12), and their number is the same as the number of paired belts, that is, of the advance races of the previous conveying units 15 and 28 of the processing station B.

Figure 11:
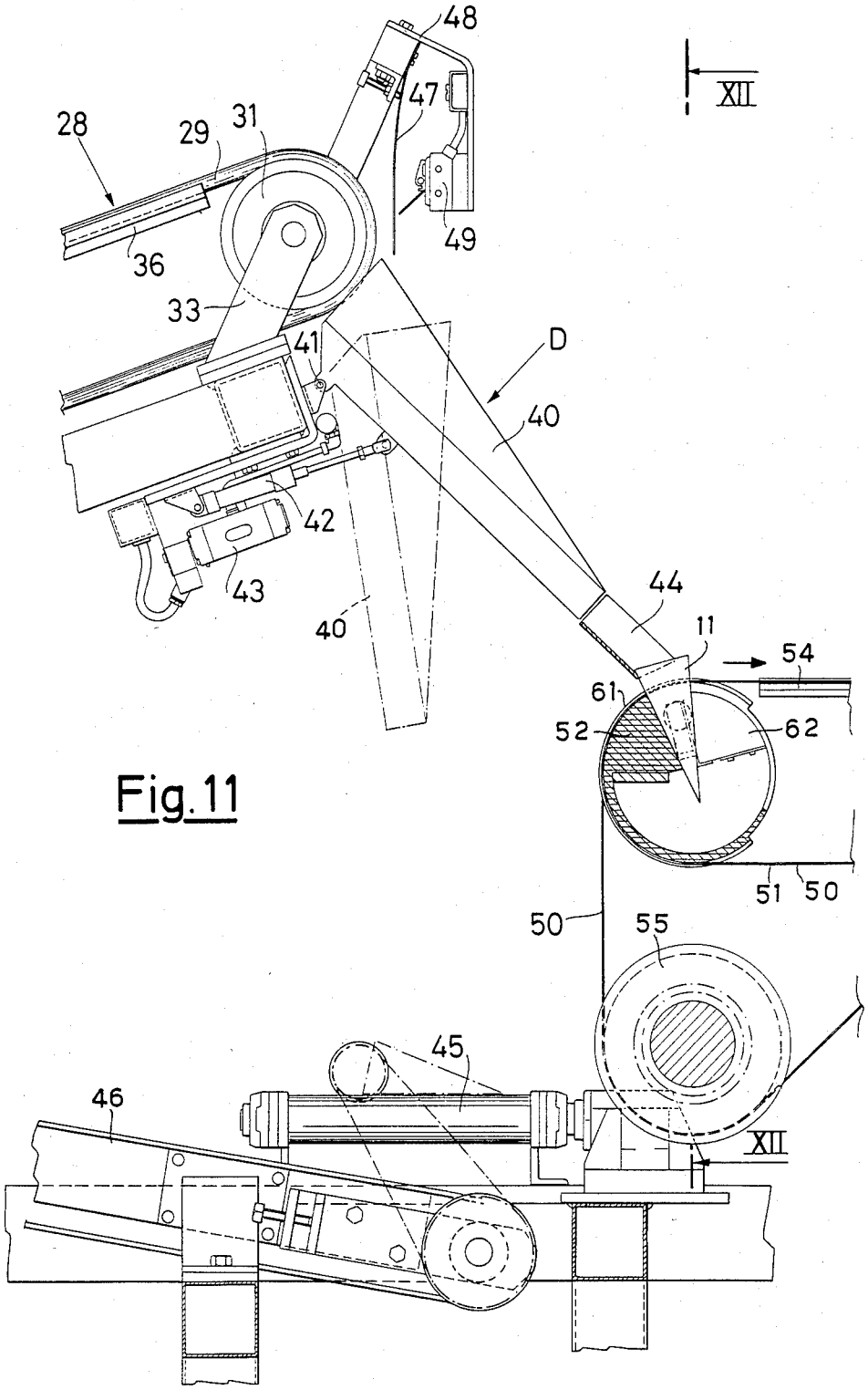
FIG. 11 is a side elevational view of the end portion of the second processing station of the system.
Figure 12:
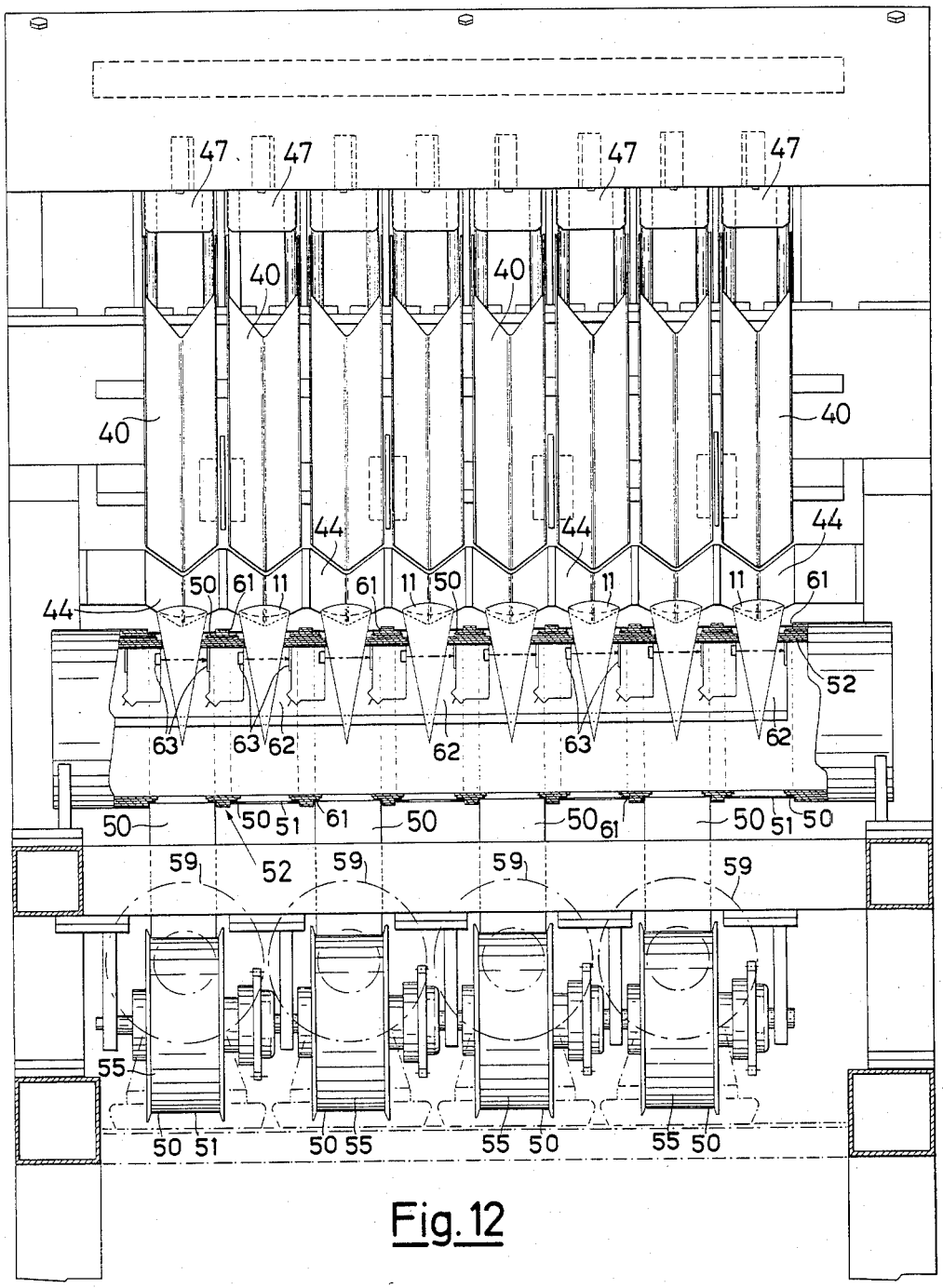
FIG. 12 is a view, taken along the arrows XII—XII of FIG. 11.

As can be seen in FIGS. 11 and 12, each chute 40 has a cross-sectional outline very much in the shape of a letter "V" and is pivoted at 41 to the supporting structure of the system. On each chute 40 a pneumatic ram assembly 42 is active, which can be energized by an electromagnetic valve 43, so as to have the chute taking either of two positions, namely: in the position shown in solid lines in FIG. 11, the chute 40 is aligned with a fixed chute extension 44 to feed the cones 11 to the third system processing section C, whereas in the position shown in dash-and-dot lines, the chute 40 is in a cone-rejecting position. In the latter position of the chute 40, the cones which reach their relative advance races from the second processing station B are dropped onto an underlying conveyor belt 45 which is a part of a cone-recycling unit, and the conveyor 45 carries away the rejected cones transversely to the direction of conveyance of the conveying units 15 and 28 of the second processing section B. At the end of the conveyor 45, another conveyor belt 46 follows (see FIGS. 1 and 14), which feeds back the rejected cones to a point upstream of the first processing station A, for example onto the conveying matting 10, as best seen in FIG. 1.

In order to encourage the transfer of the cones 11 from the advance races of the conveying unit 28 onto the respective chutes 40, provision is made, in correspondence with the idlers 31 of the belts 29 of the conveyor 28, for flexible webs 47 which are mounted on a fixed structure 48 placed above the sheaves 31. These flexible webs 47 perform the task of impressing a straightening torque to the cones 11 which reach the tops of the advance races of the conveying unit 28, because, otherwise, the cones would tend to follow the rotary motion of the idlers 31.

Whenever a cone which arrives at an advance race of the conveyor 28 bumps into the corresponding flexible web 47, the latter actuates the contact of a microswitch 49 which is mounted also on the structure 48. These microswitches 49 are thus sensors which detect the presence of a cone at the top of the relative race of the conveyor 28.

The function of these presence-sensors will be explained in greater detail hereinbelow.

Figure 13:
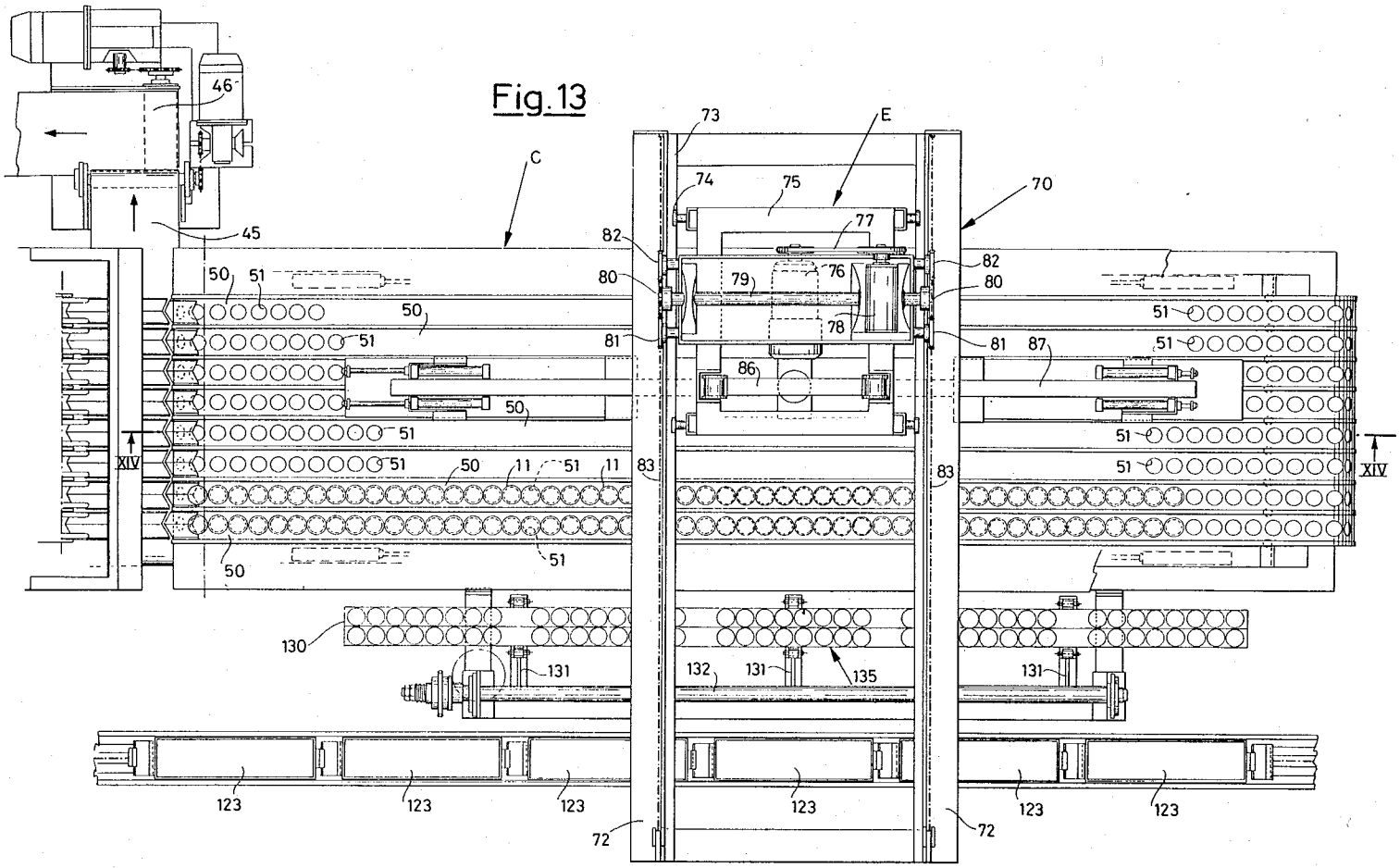
FIG. 13 is a plan view of the third processing station of the system.

The third processing station, C, is composed of a plurality of steel tapes 50 (FIG. 13), the number of which equals the number of advancement races, that is, the number of belt couples, of the conveying units 15 and 28 and thus also the number of chutes 40–44.

In each of such tapes 50, an uninterrupted row of evenly spaced apart bores 51 is formed. These bores are intended to each receive one cone 11 and thus the diameter of each bore is narrower than the diameter of the cone head or base.

Figure 14:
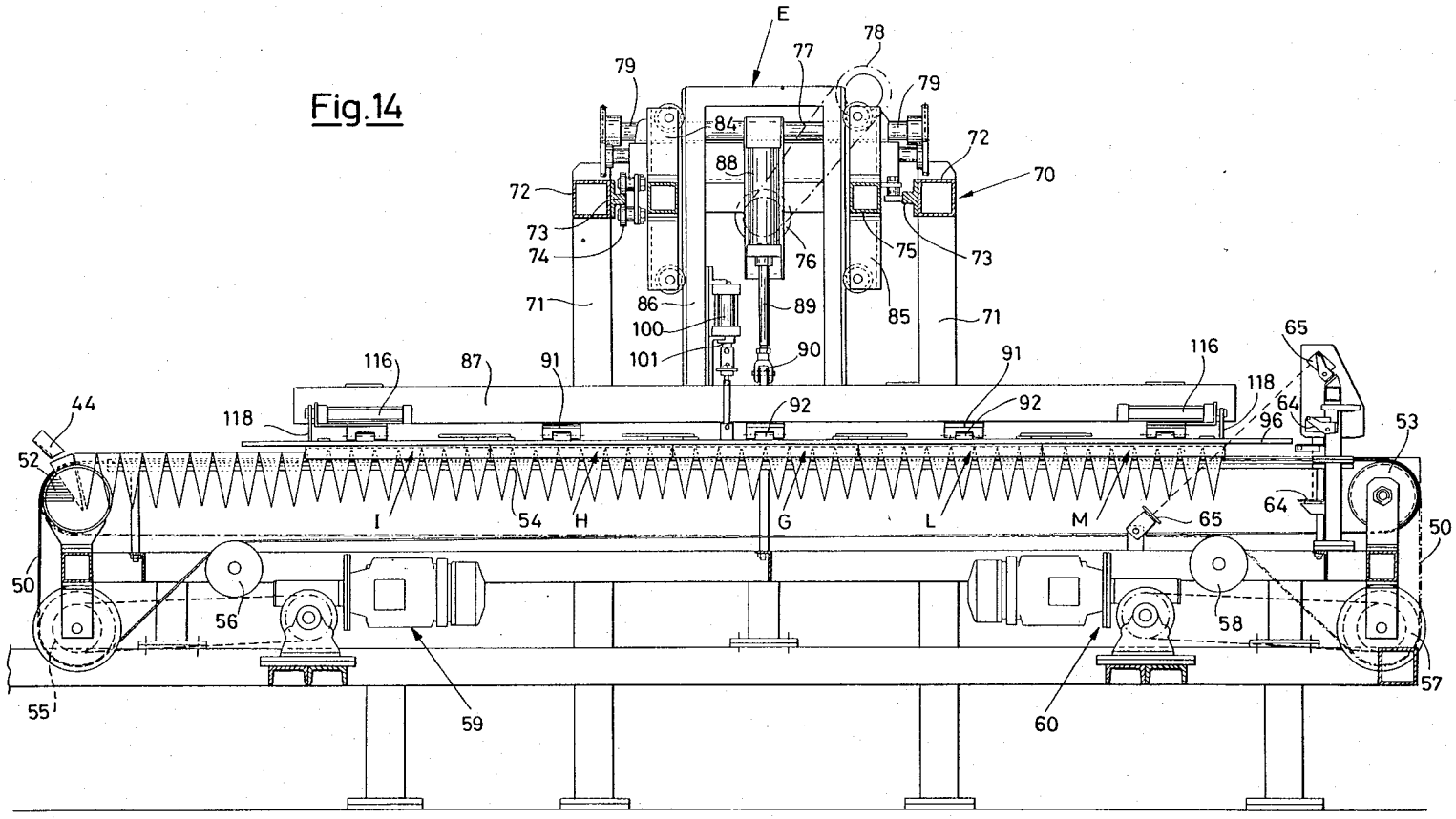
FIG. 14 illustrates said third processing station of the system, as viewed in the direction of the arrows XIV—XIV of FIG. 13.

The tapes 50 are all motorized independently of each other. The route of these tapes can best be seen in FIG. 14. All the tapes such as 50 have an active horizontal top lap, and all these top laps are parallel to each other and lie on the same plane, said plane being defined by a deflection flat member 52 and by oppositely mounted idle rollers 53 which are journalled in appropriate journals for rotation about a horizontal axis. The top laps of the tapes 50 are further supported, in the portion between the flat member 52 and the idlers 53, by horizontal slats 54 which are placed between adjoining tapes 50 (best seen in FIG. 16). A set of tapes 50 is then guided onto driving rollers 55, which are placed vertically beneath the deflection flat 52 and onto the deflecting rollers 56 to reach the idlers 53, whereas another set of tapes 50 is guided onto driving rollers 57 arranged vertically and beneath the idlers 53 and onto deflection rollers 58, the tapes of either set being arranged in an alternating sequence relative to those of the other set (see FIGS. 14 and 16). Each of the driving rollers 55 and 57 is formed with crenellations which come into engagement with the bores 51 of the respective tapes and is driven by a motorized reducing gear of its own, 59 and 60, respectively. As shown in FIG. 14, the motorized reducing gears 59 for the independent control of a tape set 50 are thus placed so as to correspond with either end, and those, 60, for the other tape set are placed so as to correspond with the opposite end of the conveyor tape beneath the top lap, the active lap, of the tapes themselves. This arrangement has been selected because of want of space, since the tapes 50 have a comparatively narrow width and are closely spaced apart, so that it would not be possible to install all of the motorized reducing gears on the same side.

It should be noted that each motorized reducing gear 59 and 60 is capable of urging forward its respective tape stepwise, each forward step having a length equal to that of the distance between two consecutive axes of bores 51.

For controlling such forward motions, that is to start and stop the motorized reducing gears 59 and 60, devices actuated by photoelectric cells are provided which will be described in greater detail later.

As illustrated in FIG. 11, the fixed deflection flat member 52 for the tapes 50 is arranged immediately beneath the fixed chutes 44, through which the cones 11 reach the processing station C of the system.

On its peripheral surface, the deflection flat 52 has guiding grooves, 61, for the tapes placed side-by-side. Corresponding with each of said grooves 61, there is formed, through flat member 52, a radial hollow space 62, which opens upwardly and in the direction of advance of the relevant tape 50 (see FIG. 11). The angular width of said radial hollow space 62 is wider than 90°.

It should be noted that, as the tape 50 is stationary, a bore 51 thereof is positioned exactly at the start of the relative hollow space 62 of the flat member 52, so that a cone, 11, which arrives from the chute 44, can be located in such bore 51 of the tape 50, thus entering via its tip the hollow space 62 of the flat member 52. As the tape 50 is then fed forward through a single step, the cone which has been positioned in said bore is free to pass unobstructed through the radial hollow space 62 of the flat member 52 unobstructed. For detecting the positioning of a cone 11 in the bore of a tape, as outlined above, and to control the attendant motorized reducing gear 59 (or 60 as the case may be) so as to start the tape motion, a photoelectric cell control device, generally indicated at 63 in FIG. 12 is provided at the sides of each of the radial hollow spaces 62 of the flat 52.

A second photoelectrically controlled device, generally indicated at 64 in FIG. 14, directly detects the presence of the bores 51 in the tape 50 and controls stopping of the relevant motorized reducing gear after each individual forward step.

It is obvious that each of the tapes 50 of the conveyor tape is equipped with a photoelectric control device 63 to start the relevant motorized reducing gear and, also, with a photoelectrically controlled device 64, for stopping the motorized reducing gear concerned after that the tape has gone ahead by one step.

Moreover, a third photoelectric control device is provided for each tape 50, said device being generally indicated at 65 in FIG. 14, for indicating the situation of filling of the tape with cones 11 positioned in its sequentially ordered bores 51 in a determined length of its top lap.

As this situation is attained, the photoelectric control device 65 delivers a signal to the electromagnetic valve 43 for actuating the pneumatic ram assembly 42 of the relative rocking chute 40, so that this chute is switched to its depressed position wherein all the cones which sequentially arrive from the processing station B of the system at the relative advance race, are recycled by means of the conveyor units 45 and 46 upstream of the processing station A.

These conditions are maintained all along the time in which the subsequent bores of the top lap of the tape considered in said determined portion are occupied by cones. As soon as, upon grasping the cones from said portion of the route, the tape is now capable of receiving cones once again, the photoelectric control device 65 delivers an acceptance signal and, as the subsequent cone reaches the top of the relative advance race of the conveyor 28, the respective sensor, that is the microswitch 49, controls, via the electromagnetic valve 43 and the ram assembly 42, the shifting back of the respective rocking chute 40 to its position in which it delivers the cones towards the processing station C of the system.

The cone-grasping unit E will now be described with reference to FIGS. 13 to 16.

The unit E is mounted on a supporting structure 70 overlying the processing station C and the adjacent positions F of the system. The supporting structure 70 has uprights 71 and two longitudinal members 72 arranged cross-wise relative to the direction of advance of the tape conveyor 50 in the processing station C. On the longitudinal members 72 there are mounted horizontal guides 73 for guiding the rollers 74 of a horizontally shiftable carriage 75. The shift in either direction of the carriage 75 can be controlled by a motor 76 to be mounted on the carriage 75 itself: the motor, via a belt or similar drive transfer means 77, actuates a reducing gear 78, the output shaft 79 of which carries at its opposite ends gears 80. Each gear such as 80 cooperates with two further gears 81–82 (FIG. 16) which are also mounted for rotation on carriage 75 and around each of said three groups of three gears each, 80, 81, 82, a chain 83 runs, which has both its ends fixedly secured to the ends of the longitudinal members 72. It is apparent that the rotation of the gears 80 as controlled by the motor 76 via the reducing gear 78 drives the carriage 75 along the guides 73. The carriage 75 has vertical-roller guideways 84–85 (FIGS. 14–15) for a slider 86 which has the shape of a frame and carries at its bottom portion a beam 87 which extends parallely to the direction of advance of the conveyor tape 50 in the processing station C of the system. The carriage 75 also carries a pneumatic ram assembly 88, and the stem 89 of the piston thereof, as it emerges from the bottom end of the ram, is connected, in correspondence with its distal end, at 90, to said beam 87 which belongs to the slider 86. By the pneumatic ram assembly 88 it is thus possible to control the lifting and the depressional movements of the slider 86 and of the beam 87 relative to the carriage 75, as can be clearly appreciated by comparing FIGS. 14 and 15 viewed together.

The bottom portion of the beam 87 carries plates 91 (also see FIG. 18) and, on the bottom side of these plates there are, as pivoted by means of groups of four hinges 92, 93, 94, 95, four shaped longitudinal bars 96, 97, 98, 99.

Figure 18:
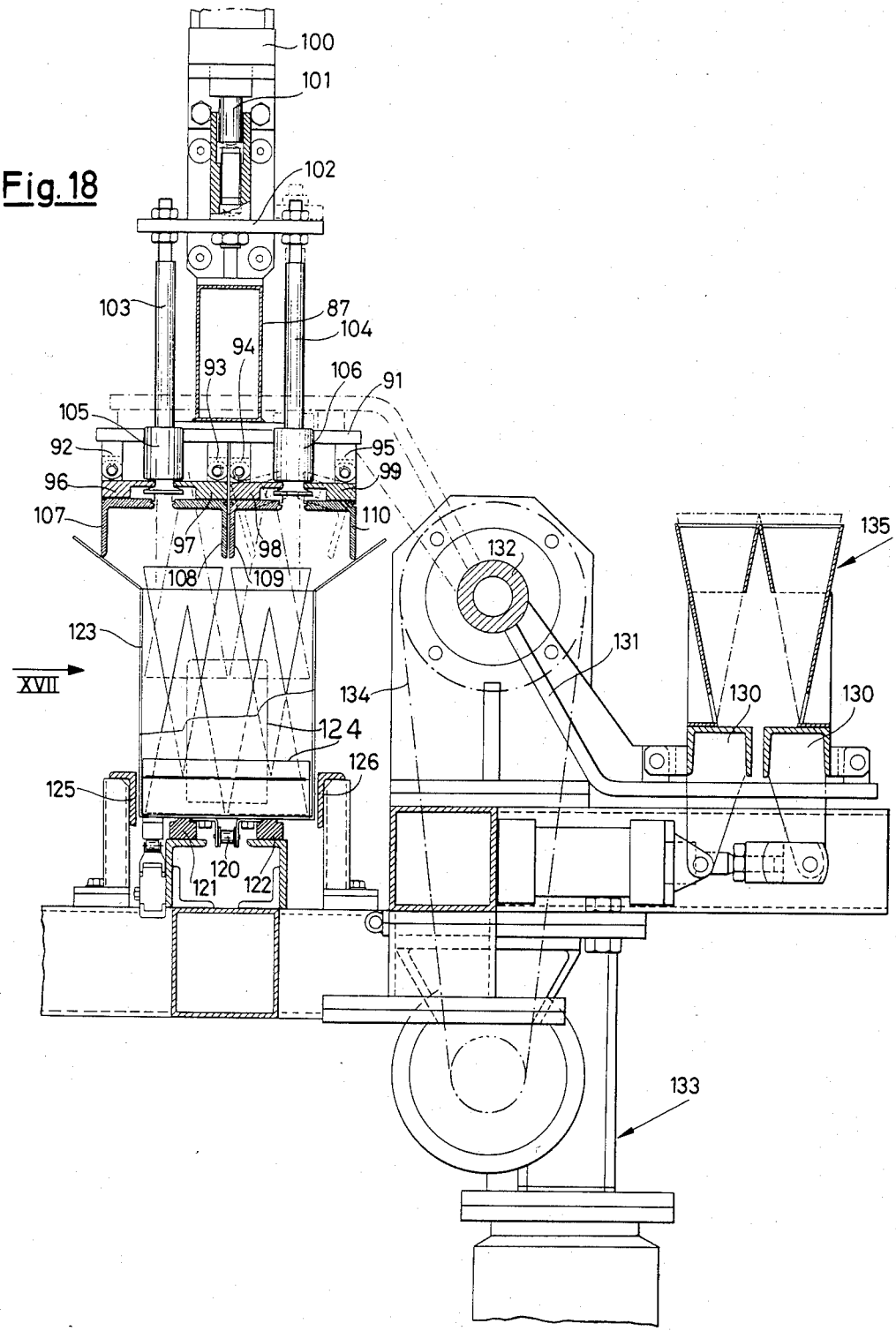
FIG. 18 is an elevational view, partly in cross-section, of a detail of an operational stage of the system.

To the frame of the slider 86 a pneumatic ram assembly 100 is fastened, having a piston, the stem of which, 101, emerges from the bottom wall of the cylinder and carries at its end a transversal plate 102 to which two rods 103, 104 are secured. The shaped headers 105, 106 of the latter rods cooperate with the adjacent edges of the couples of bars 96, 97 and 98, 99, respectively, as best seen in FIG. 18. As soon as the piston and the stem 101 of the cylinder 100 are in the depressed position (as shown in solid lines in FIG. 18), the bars from 96 to 99 lie on the same horizontal plane, whereas, as the piston and the stem 101 are lifted, the bars are caused to swing, pairwise, in opposite directions (as shown in dash-and-dot lines in FIG. 18) in the sense that the bars 96 and 98 are rotated in the counterclockwise direction while the bars 97 and 99 are rotated in the clockwise direction, as viewed in FIG. 18.

To the central portion of the bars 96–99 and exactly to the bottom surface thereof, there are affixed respective jaws 107, 108, 109 and 110 of a set of clamping jaws G, which follow the rocking motions of the same bars and are intended to grasp the heads (bases) of the cones 11 of a first group of cones marshalled in two rows in the bores 51 of a couple of tapes 50 which are in adjacent positions in the conveyor tape, as the cone-grasping unit E is positioned above said pair of adjacent tapes and the slider 86 is depressed so as to approach the tapes, as shown in FIG. 14.

Figure 15:
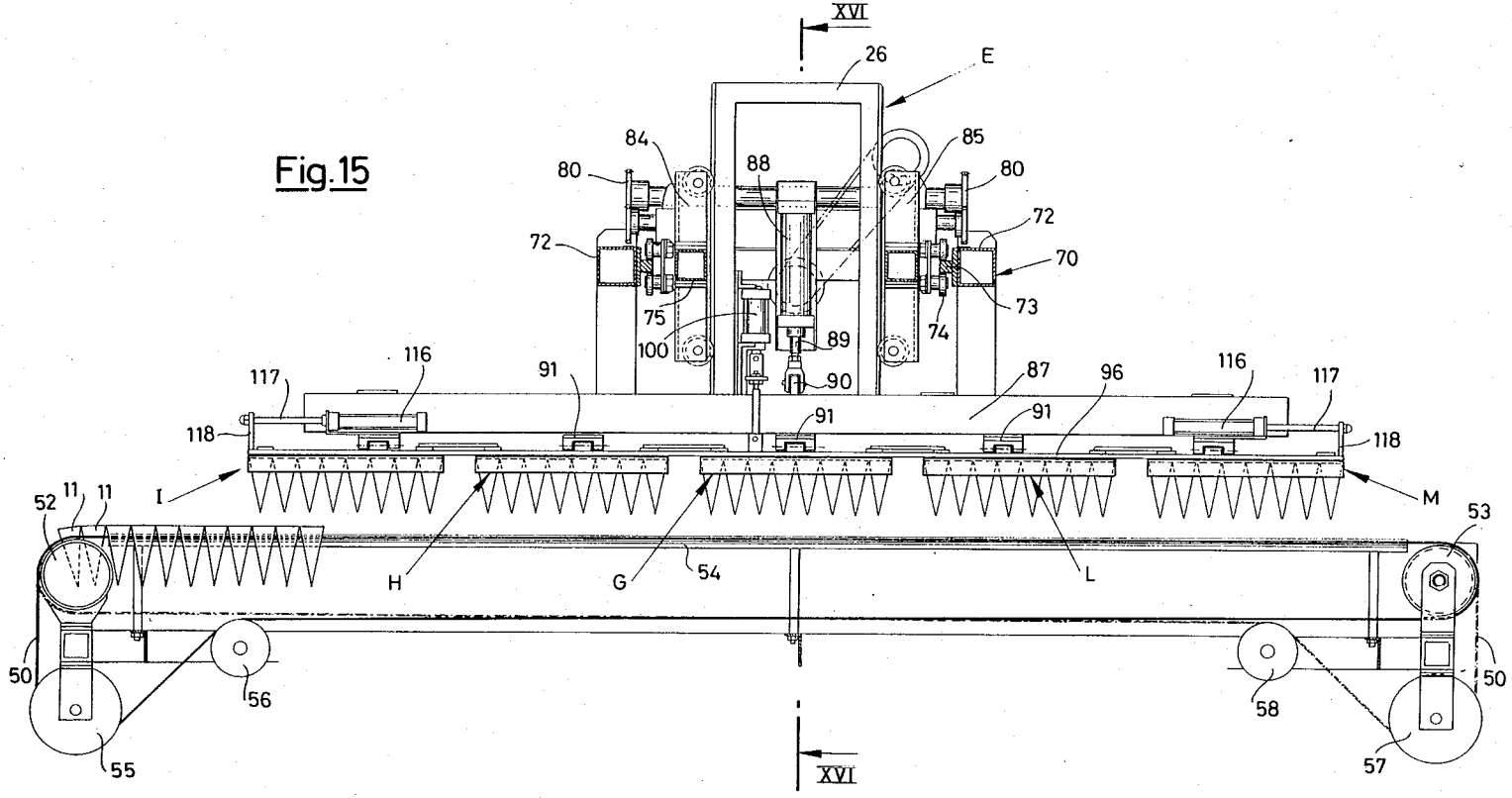
FIG. 15 is a view akin to that of FIG. 14, but shown in a different working position.

In the example shown herein, in addition to said central set, G, of grasping jaws 107–110 secured to said swingable bars, four additional groups are provided, namely H, I, L, M, of clamping jaws (see FIGS. 14 and 15) which are entirely similar to those of the central set G: of the latter sets, two, viz. H and I, are arranged on the left, and the other two sets, viz., L and M, are placed on the right relative to the central set G, as shown in FIGS. 14 and 15. Also these further jaw sets are connected to the respective longitudinal bars 96–99 so as to follow their rocking motion as controlled by the pneumatic ram 100. However, these jaws of the other sets H, I, L, M are not affixed to the respective bars 96–99 but are limitedly displaceable in the longitudinal direction with respect thereto.

Figure 19:
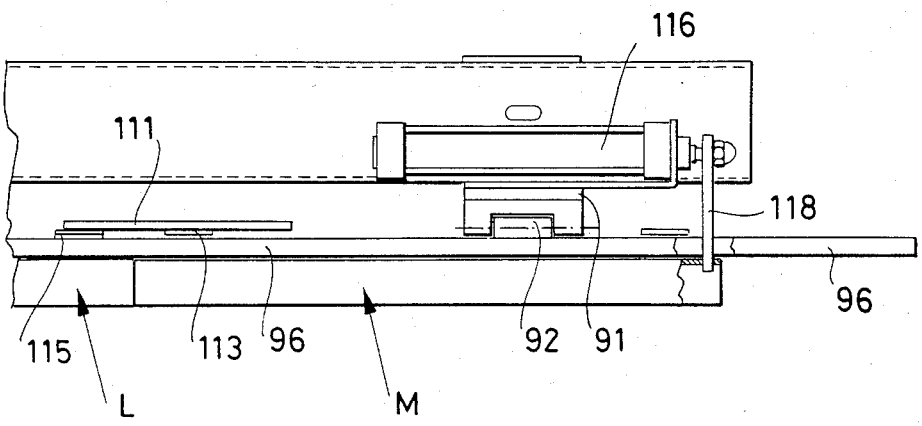
FIGS. 19 and 20 show another detail view of the system.
Figure 20:
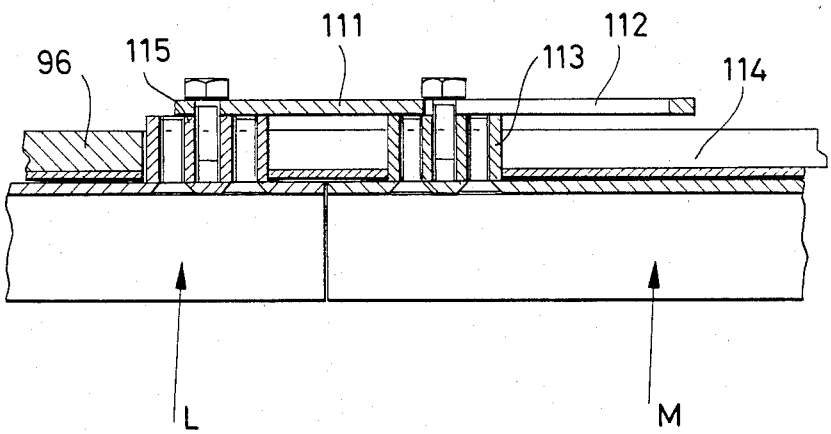

More particularly, each of the jaws 107–110 is connected to the companion jaw belonging to the two nearby sets H and L by a slot and, likewise, each jaw belonging to the sets H and L is connected to the respective jaw of the outer nearby sets I and M still by means of a slotted plate: each of said slotted plates (see FIGS. 19 and 20) comprises a slab 111 fastened by a pin 115 to the jaw belonging to the innermost set, and the slab has a longitudinal slot 112 in which a pin 113 can slide, which is integral with the closest outermost jaw. Of course the bars 96–99 also have appropriate longitudinal slots 114 in which the pins 113 and 115 are allowed to glide, as shown in FIG. 20.

In correspondence with the two opposite ends of the beam 87 there are mounted, integrally therewith, pairs of pneumatic rams 116, the stems 117 of which, with the intermediary association of plates 118, are connected to pairs of jaws of the respective outer jaws sets I, M.

Now, it is apparent that under the conditions in which the stems 117 have been brought back in the interior of the respective pneumatic rams 116 (as viewed in FIG. 14), the sets of movable jaws H, I, L, M are shifted towards the central fixed jaw set G which contains gripping jaws, so as to make up an uninterrupted and continuous array of jaws. This is the condition in which the cone-grasping unit E provides to draw two continuous rows of cones 11 from the bores 51 of two adjoining tapes 50 of the conveyor tape in the processing station C of the system.

Conversely, as the pneumatic rams 116 are actuated (after that the cones are grasped as outlined above and after the previous lifting of the entire slider 86 and its beam 87) so as to have the respective stems 117 jutting out, these latter, by means of the plates 118, act upon the jaws belonging to the two external sets I and M, causing them to slide in opposite directions relative to their respective bars 96–99. During an initial portion of this motion, the pins 113 integral with the jaws of the external sets I and M slide freely in the slots 112 of the plates 111 which are integral with the jaws of the respective innermost sets H and L, until reaching the end of stroke positions in said slots: from that instant of time onwards, with the intermediary of the plates 111, the jaws of the sets H and L also are dragged and the pins 113 integral therewith slide in the slots 112 of the plates 111 which are integral with the jaws 107–110 of the central jaw set G until reaching the end of stroke position in said slots. On completion of the movement impressed by the pneumatic rams 116, the jaw sets H, I, L, M are in the position shown in FIG. 15 and are evenly spaced apart relative to each other and also relative to the central jaw set G. Such spacing corresponds to that of the carbons in which the groups of ice-cream cones must be packaged, as will be better explained hereinafter.

The operation of grasping the cones by the unit E takes place at the instant where two adjoining tapes 50 of the conveyor tape in the processing station C are filed with cones, that is to say, as the respective photoelectric control devices, 65, deliver congruous signals to a control central switchboard. This switchboard originates, at the very outset, but a displacement of the carriage 75 so as to position the pairs of jaws 107–108 and 109–110, in the open condition, for all the sets G, H, I, L, M which have been approached to each other, above the two adjoining tapes which are completely filled with cones, whereafter the slider 86 is depressed until reaching the grasping condition of the pairs of jaws relative to the two cone rows inserted in the tape bores, and, lastly, the jaws of the two pairs are clutched to grasp the cone heads (bases) (see FIG. 14). Once the latter condition has been reached, the slider 86 is controlled so as to be lifted again, so that the two rows of cones grasped by the couples of jaws are withdrawn from the bores 51 of the tapes 50. Now, the pneumatic rams 116 are actuated so as to set the five groups of cones spaced apart, which have been grasped by the respective couples of jaws (by so doing, the condition depicted in FIG. 15 is obtained).

Provision should now be made to carry out the operation of packaging the cones into the cartons in a proper order.

In order for the individual cartons to be both completely and rationally filled, it has been ascertained that it is advisable to deposit in each carton two cone rows with the tips up and two cone rows with the tips down.

Inasmuch as the cones grasped by the grasping unit E are with their heads (bases) up and their tips down, it becomes necessary to provide alternately reversion of the orientation of the cones to package them into the carton.

This result is achieved in the system according to the invention in the following way.

As outlined above, besides the processing station C of the system two adjoining positions, F, are provided: in either of these two adjoining positions a carton-conveyor is provided and in the other position a tipping device is present.

Figure 17:
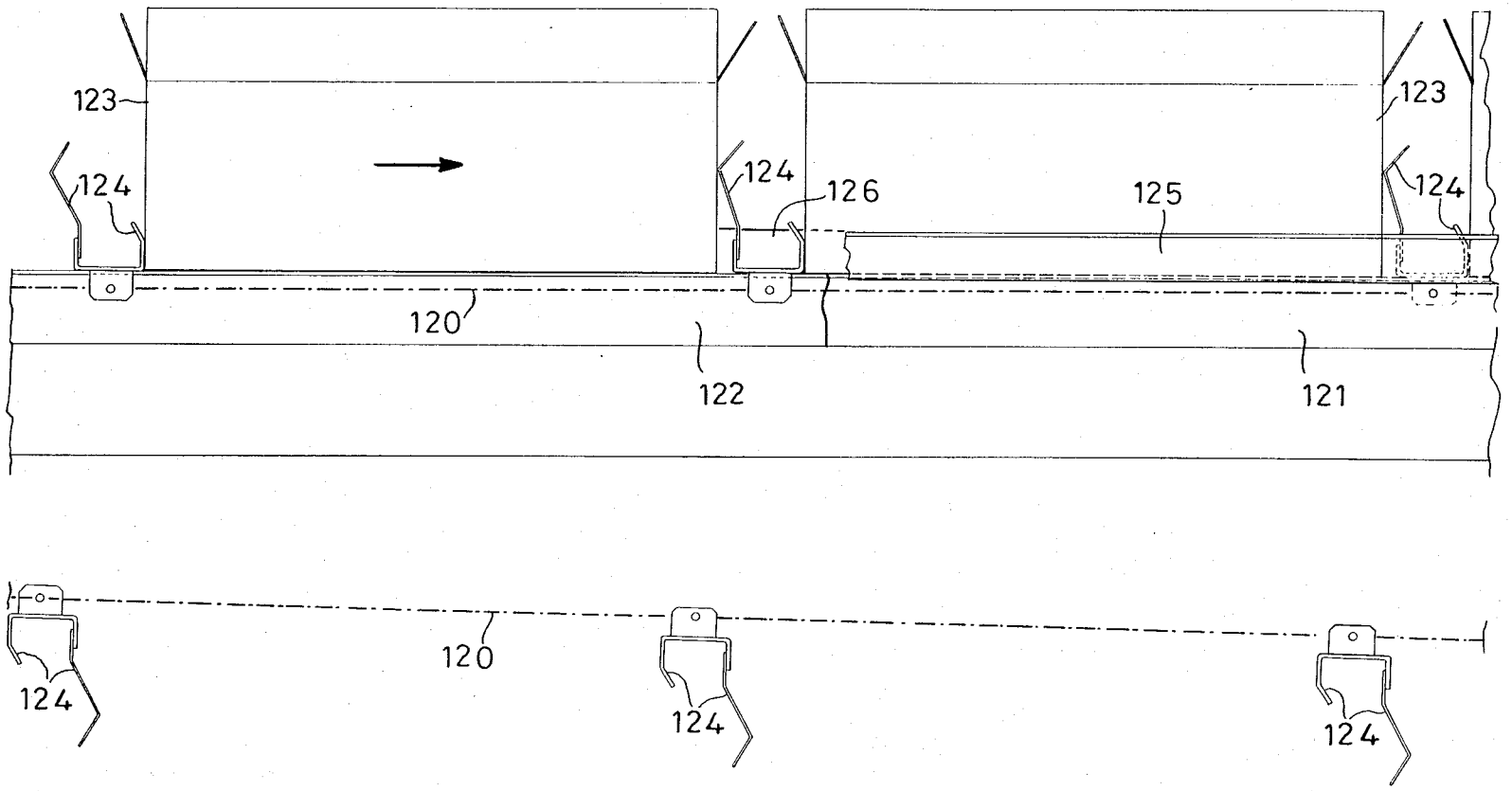
FIG. 17 shows a detail in side view, as viewed in the direction of the arrow XVII of FIG. 18.

The carton-conveyor is substantially composed of a chain 120 (see FIGS. 17 and 18) the upper lap of which, being the active lap, runs between two continuous carton-supporting skids 121, 122, for the cartons, 123, which are pushed in the direction of the arrow shown in FIG. 17, by the agency of abutments 124 which are integrally secured to the chain 120 and fulfil also the task of arranging the cartons spaced apart from each other by the preselected gap. The cartons 123 are laterally guided by two rules 125, 126, which keep the cartons in alignment during their travel.

It should be noted that the empty cartons are fed forward by their conveyor until such times as the first five cartons (in the case in point, by way of example,) are exactly marshalled laterally at the locations taken by the sets, G, H, I, L, M of gripping jaws of the cone-grasping unit E in the condition of mutual spacing from each other (FIG. 15). It should likewise be noted that the space interval between any carton and its next on the conveyor corresponds, substantially, to the mutual distance between said sets of grasping jaws in the same situation. The machine direction of the carton-conveyor is parallel to the direction of the conveyor tape 50 in the processing station C of the system.

Between the carton-conveyor and the conveyor tape 50, in a second position adjoining to said conveyor tape 50, a tipping device is installed.

Such a tipping device is substantially composed of a couple of bars, 130, which are supported by a plurality of bent arms 131 (FIGS. 13, 16 and 18), said arms being secured, at their free ends, to a common shaft 132, supported for rotation by appropriate journals fixed in space. Provision is made for a motive unit 133 which is capable, with the intermediary of a chain drive 134, of causing the shaft 132 to go through a 180-degree rotation between the two positions aforementioned, which are indicated, respectively, in solid lines and in dash-and-dot lines, in FIG. 16. It should be observed that the motive unit 133 is capable of moving the shaft 132, and, concurrently therewith, the arms 131 and the bars 130 with a uniformly accelerated motion, at least during the stage of rotation from the position indicated in solid lines to the position indicated in dash-and-dot lines. To the pairs of bars 130 are secured, appropriately spaced apart from each other, groups of seats 135, which are adapted to receive as many groups of cones. The mutual distance between these groups of seats is equal to the mutural distance between the sets from G to M of gripping jaws (in their open positions, FIG. 15) and the number of seats in any seat group corresponds to the number of cones which can be grasped by each set of grasping jaws (in the example shown herein, there are sixteen cones arranged in two parallel rows). Each seat has an outline which corresponds to that of a cone, which latter, as it is slipped into one of these seats, remains with its head (cone base) slightly jutting from the seat in question.

Figure 16:
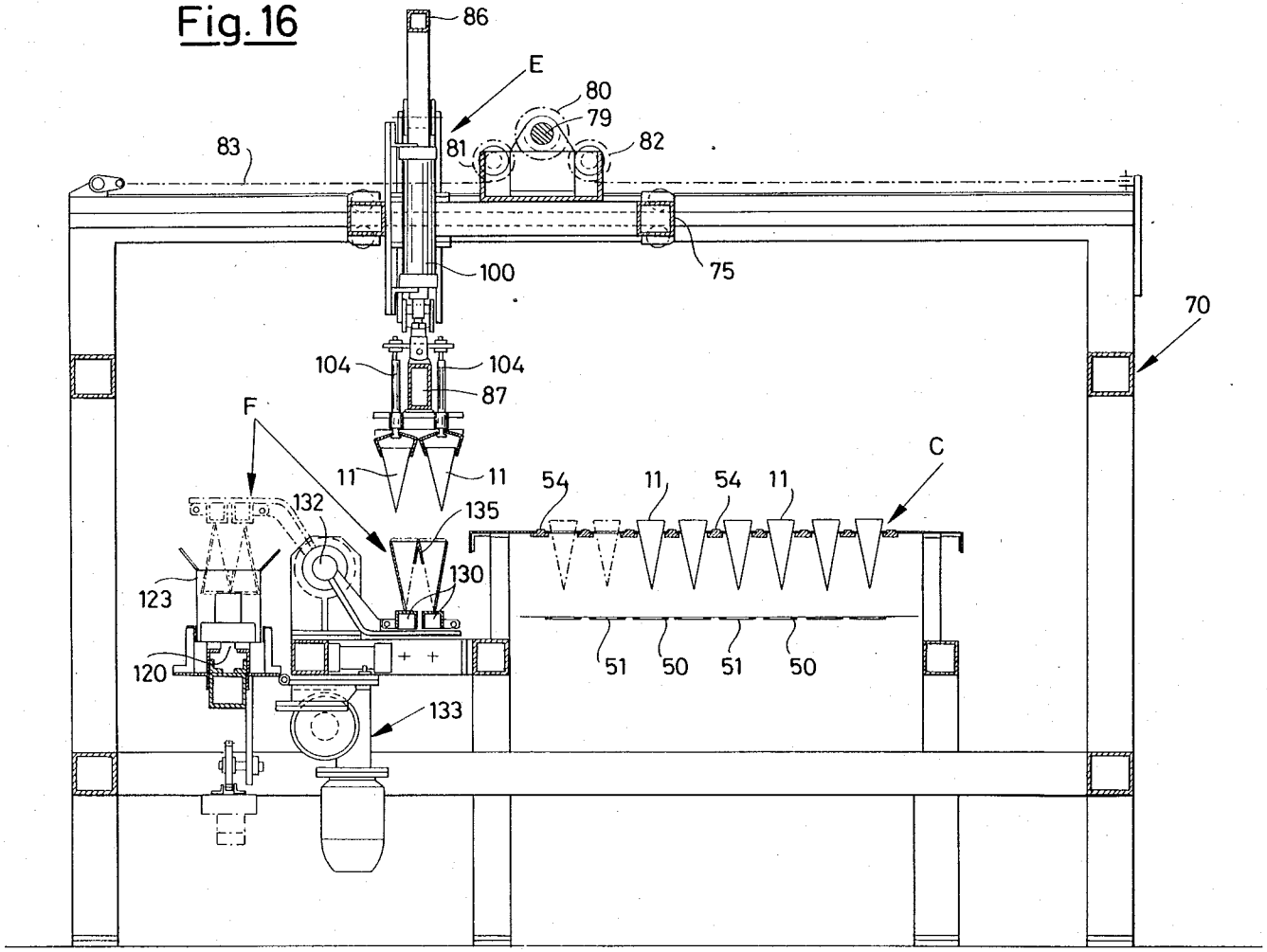
FIG. 16 is a cross-sectional view, in elevation, taken along the line XVI—XVI of FIG. 15.

As can be appreciated by viewing FIGS. 16 and 18, the distance between the axis of the shaft 132 intended for the rotation of the tipping device, and the central axis of the carton-conveyor is such that, in the tipped down position (indicated in dash-and-dot lines), the groups of seats 135 of the tipping mechanism which carries the cones are partially slipped, from above, into the relative cartons 123.

The cone-packaging step in proper sense takes now place in the following manner.

The cone-grasping unit, E, after having grasped the groups of cones from two adjoining tapes 50 and being in the position shown in FIG. 15, is transversely shifted until positioned above the tipping device (see FIG. 16). The slider 86 is now lowered until such time as the cones which have been clutched by the couples of jaws are inserted in the seats of the tipping device. The jaws are then actuated so as to clear the cone heads (bases), the slider 86 is lifted again and the cone-grasping unit E can be shifted so as to carry out the grasping of two additional cone rows from another pair of adjoining tapes 50.

The tipping device is meanwhile actuated to to introduce the groups of cones into the respective empty cartons which are held ready on the relative conveyor. During the tip-over motion of the tipping mechanism, the cones lying in the seats 135 are overturned from their head-up position to their head-down position. The frictional forces obtaining between th seats of the tipping device and the cone surfaces would not suffice, alone, to hold the cones in their seats in points of the rotation patch which are beyond 90°. It is exactly for this reason that the tipping mechanism is actuated with a uniformly accelerated motion in such a way that a component force may exist, in any case, which acts upon the cones and is sufficient to hold the cones in their seatings.

Once that the tipping mechanism has dumped a first set of overturned cones into the respective empty cartons, the device is brought back to its resting position again in order to be in readiness for receiving another one set.

Meanwhile, however, the cone-grasping unit E, after having taken from two further tapes 50 two cone rows and provided to subdivide the grasped cones into two groups (FIG. 15), is directly shifted to a position above the cartons which had already been filled with overturned cones which still lie side by side at the station C of the system (see FIG. 18), so as to dump into the same cartons as many cone groups, which, this time, are instead positioned with their tips down. This second set of cones is inserted in the gap between the inverted cones of the first set so that the empty spaces of the carton are satisfactory filled. It is to be remembered that the cartons are made of paper board so that they are capable of adapting themselves to the unitary block of cones which have been introduced in each carton.

Once that the cartons have been filled, the attendant conveyor is energized to carry the filled cartons away and to position further empty cartons in the loading positions.

The number of cartons which can be filled at a time is a function of the number of cones for each carton and of the splitting of the feed main stream one wishes to carry out. Stated another way, the potential throughput of the system and the characteristics of the packaging containers are critical factors.

It must also be taken into account that, if the alternating sequencing of the direction of the cones to be packaged is not a must, the tipping mechanism can be dispensed with. If so, packaging is carried out, directly and exclusively, by the cone-grasping device E. Such grasping device could also be utilized to grasp a different number of cone rows all at a time, for example a single row only, or more than two cone rows.

As can be appreciated from the foregoing disclosure, the packaging system according to the present invention operates in quite automatic way and does not require any manual intervention. This achievement has been made possible by virtue of the several mechanisms and means which warrant faultless positioning and orientation of the loosely fed cones. The potential throughput of the system can be adapted to any requirements by providing an appropriate splitting of the main feed stream for the cones. In this connection, it can be observed that the system lends itself to be doubled, in the case that it is intended to serve for a factory having a great production capacity: in cases of this kind, for example, two packaging systems arranged in parallel can be provided, to be fed by the production installation via an appropriate switching assembly.

I claim:

1. A system for packaging ice-cream cones and similar articles, comprising:

a first processing station which includes a chute having individual races for splitting the main feed stream of the loosely incoming cones into a predetermined number of individual substreams and for previously orienting the cones with their axes parallel to the direction of each individual sub-stream;

a second processing station which includes a pair of conveying belts, the number of which equals the number of individual sub-streams as formed in the first processing station, to originate an orderly temporary cone-storage field having a forward motion, each of said pair of conveying belts having operatively associated therewith devices for marshalling the cones mutually spaced apart between the respective two belts, the cone axes being vertical and the cone tips upside down;

a third processing station which further comprises a plurality of tapes which are parallel and horizontal, corresponding to the number of pairs of conveying belts of the second processing station, each tape having a row of seats adapted to receive individual cones with their axes vertical and their tips pointing downwards, each of said tapes being independently motorized relative to the other tapes, and means for detecting the position of each individual cone in any of the seats of the tapes and for consequentially commanding the forward advance of the relative tape by one step corresponding to the distance between the axes of two consecutive seats;

means for transferring the cones from said second processing station to the third processing station and which further comprises a plurality of members which can be controlled to take either of two positions, one position being for feeding the cones to the seats of the tapes of the third processing station and the other position for rejecting the cones coming from the second processing station, said reject position of said members being operatively associated with a cone-recycling unit to a position upsteam of the first processing station, detection means operatively associated with each of said tapes of the third processing station for detecting the presence of the cones in a determined number of consecutive seats of the respective tape and for controlling the switching of the relative transfer member from said first to said second position if cones are present in said seats and for permitting switch-back of said member to its first position if said seats are empty;

means located in said third processing station for grasping the cones positioned in said determined number of seats of at least one tape, said means for grasping being liftable perpendicularly to the direction of advance of the parallel tapes of the third processing station to selectively grasp the cones from the plurality of tapes to transfer the grasped cones to at least one position adjacent said tapes and to introduce the cones into empty cartons.

2. A system according to claim 1, wherein said at least one position further comprises first and second positions, adjacent the parallel tapes of the third processing station whereto the cones grasped by the cone-grasping unit are alternatingly transferred, and further comprising in either of said first and second position, a tipping mechanism adapted to receive the cones grasped by said unit in a position wherein the cones have their tips upside down and to overturn of 180° the thus received cones to arrange them with their tips up and, in the second of said positions, a carton conveyer adapted to feed a succession of empty cartons close to said third processing station and to carry away the cone-filled cartons, said grasping unit being adapted to alternatingly place the series of grapsed cones onto said tipping mechanism and directly into the cartons, the cones deposited on said tipping mechanism being deposited thereby into the cartons as the 180-degree tipping motion of said mechanism is completed.

3. A system according to claim 1, wherein said chute of the first processing station further comprises partition walls located between the individual races and each race has a cross-sectional outline which tapers in the direction from the intake to the outlet.

4. A system according to claim 1, wherein the second processing station further comprising first and second sequentially arranged conveying mechanisms having pairs of belts.

5. A system according to claim 4, wherein said first and second conveyors slope upwards, the slope of the second conveyor being steeper than that of the first conveyor.

6. A system according to claim 4, wherein said first and second conveyors are motorized by independent reducing gears, the advance speeds impressed by said motorized reducing gears being higher for the first conveyor than for the second conveyor.

7. A system according to claim 4, wherein first and second V-shaped channels are positioned beneath each pair of belts of the first conveyor in succession and longitudinally spaced apart from one another, the distance between said channels and the relative pair of belts being shorter than the height of the cones suspended between the belts, the second channel being closer than the first channel to the relative pair of belts.

8. A system according to claim 4, wherein contiguous pairs of belts of the first conveyor are spaced apart from one another by profiles having a triangular outline in cross-section.

9. A system according to claim 8, wherein said profiles further comprises webs mounted thereon to prevent gathering of the cones.

10. A system according to claim 4, further comprising a transversal resilient fencing bar member located above said first conveyor.

11. A system according to claim 4, wherein a V-shaped channel is positioned beneath a first shank of each pair of belts of the second conveyors, spaced apart from the relative belt pair by a distance shorter than the height of the cones suspended between the belts.

12. A system according to claim 4, further comprising means provided between said first and second conveyors, for providing the continuity of the advance races defined by respective pairs of belts of the two conveyors.

13. A system according to claim 1, wherein the transfer means further comprise rocking chutes and and an extension fixed cute connected to said rocking chute.

14. A system according to claim 13, further comprising an electromagnetic valve and a pneumatic ram-piston wherein each rocking chute is connected to said pneumatic ram-piston assembly actuatable by said electromagnetic valve.

15. A system according to claim 13, wherein a flexible web is arranged above the inlet opening of each of the rocking chutes to encourage the introduction of the cones into said chutes and further comprising individual pressure sensors to be actuated by said flexible webs.

16. A system according to claim 13, wherein said fixed chutes are positioned immediately above a deflection flat member for the tapes of the third processing station, said deflection flat member having peripheral grooves formed therein for guiding the tapes and radial hollow spaces corresponding with each groove, open upwardly and in the direction of advance of the tapes, for the positioning and the guiding of the cones coming from the chutes.

17. A system according to claim 16, further comprising a photoelectric control device corresponding with each of said radial hollow spaces of the deflecting flat member for detecting the positioning of a cone in a seat of the relative tape, said seat being positioned corresponding with said hollow space.

18. A system according to claim 1, further comprising a photoelectric control device operatively associated with each of said tapes of the third processing machine and adapted to detect the presence of the sequentially ordered seats of the relative tape for controlling the stoppage of the respective motor after each individual step of the stepwise advance motion.

19. A system according to claim 1, wherein the cone-grasping unit is mounted on a supporting structure overlying the third processing station and further comprising horizontal longitudinal members arranged transversely to the direction of advance of the tapes in said third processing station, wherein said cone-grasping unit further comprises a motorized carriage shiftable in both directions along ways integral with said longitudinal members, a slider member guided in vertical guideways for said carriage, means for lifting and lowering said slider member, a beam integral with said slider member and extending parallel to the direction of advance of the tapes, grasping means for the cone heads, carried by said beam, and means for controlling said grapsing means.

20. A system according to claim 19, wherein said means for lifting and lowering said slider further comprises a pneumatic ram the stem of which is connected to the beam integral with the slider.

21. A system according to claim 19, wherein said grasping means is sub-divided into a plurality of sets and further comprising means for controlling mutual spacing between the individual sets.

22. A system according to claim 21, wherein said beam integral with the slider member further comprises hingedly secured thereto longitudinal bar members and wherein said grasping means sub-divided into sets is, at least in part, displaceable longitudinally relative to said bars.

23. A system according to claim 22, wherein said sets of grasping means are connected to each other by means of slotted plates.

24. A system according to claim 22, wherein each of the bars centrally carries a fixed set of grasping means, and, laterally thereof, other sets which are displaceable.

25. A system according to claim 19, wherein said grasping means further comprise pairs of jaws and wherein said control means are adapted to shift the jaws of each pair from a position of parallelism to a position of divergence and vice versa.

26. A system according to claim 25, wherein said jaw-controlling means further comprise a pneumatic ram the stem of which cooperates with the jaws to bring said jaws from their parallel position to their convergent position and vice versa.

27. A system according to claim 2, wherein said tipping mechanism further comprises a rotatable shaft, a plurality of arms keyed to said shaft and carrying a supporting member for seats adapted individually to receive cones in vertical position with the cone tips upside down, and motive means being provided for impressing to said shaft rotations through 180° in either direction with a uniformly accelerated motion.

* * * * *